US006818843B2

(12) United States Patent
Meixner et al.

(10) Patent No.: US 6,818,843 B2
(45) Date of Patent: Nov. 16, 2004

(54) MICROSWITCH WITH A MICRO-ELECTROMECHANICAL SYSTEM

(75) Inventors: Michael Meixner, Erlangen (DE); Leena Paivikki Buchwalter, Hopewell Junction, NY (US); Jennifer Louise Lund, Brookeville, MD (US); Hariklia Deligianni, Tenafly, NJ (US)

(73) Assignee: Telefonaktiebolaget LM Ericsson, Stockholm (SE)

( * ) Notice: Subject to any disclaimer, the term of this patent is extended or adjusted under 35 U.S.C. 154(b) by 0 days.

(21) Appl. No.: 10/361,418

(22) Filed: Feb. 10, 2003

(65) Prior Publication Data

US 2004/0021151 A1 Feb. 5, 2004

(30) Foreign Application Priority Data

Feb. 11, 2002 (EP) ..... 02002963

(51) Int. Cl.[7] ..... H01H 57/00
(52) U.S. Cl. ..... 200/181; 307/125
(58) Field of Search ..... 200/181; 307/125

(56) References Cited

U.S. PATENT DOCUMENTS 5,677,823 A 10/1997 Smith
6,069,540 A * 5/2000 Berenz et al. ..... 333/101
6,127,744 A 10/2000 Streeter et al.
6,143,997 A 11/2000 Feng et al.
6,543,286 B2 * 4/2003 Garverick et al. ..... 73/514.18

* cited by examiner

*Primary Examiner*—Douglas Wille

(57) ABSTRACT

Microswitch, comprising a base element (G) with a contact surface (KG) and an electrode (EG), and a switching element (S) with a contact surface (KS) and an electrode (ES) disposed opposite the electrode (EG) of the base element (G) at a distance (g). The switching element (S) is provided with a spring constant and is connected at least with a part of its edge portion with the base element (G) in a fixed manner. The contact surfaces (KG, KS) form a switching contact which is closable against a reaction force caused by the spring constant by means of a voltage applied to the electrodes (EG, ES). The base element (G) and the switching element (S) each comprise an auxiliary electrode (HG, HS) at a distance (a) from the electrode (EG, ES), to which a voltage can be applied. For opening the switching contact the electrodes (EG, ES) have a first voltage potential (U1) and the auxiliary electrodes have a second voltage potential (U2) of the voltage. The voltage potentials (U1, U2) effect an accumulation of positive and negative charge carriers on the surface portions of the electrodes (EG, ES) and the auxiliary electrodes (HG, HS) such that surface portions with positive and negative charge carriers are opposite each other in a lateral direction and surface portions with the same charge carriers are opposite each other in an orthogonal direction.

8 Claims, 2 Drawing Sheets

MICROSWITCH WITH A MICRO-ELECTROMECHANICAL SYSTEM

CROSS-REFERENCE TO RELATED APPLICATIONS

Figure 1A:
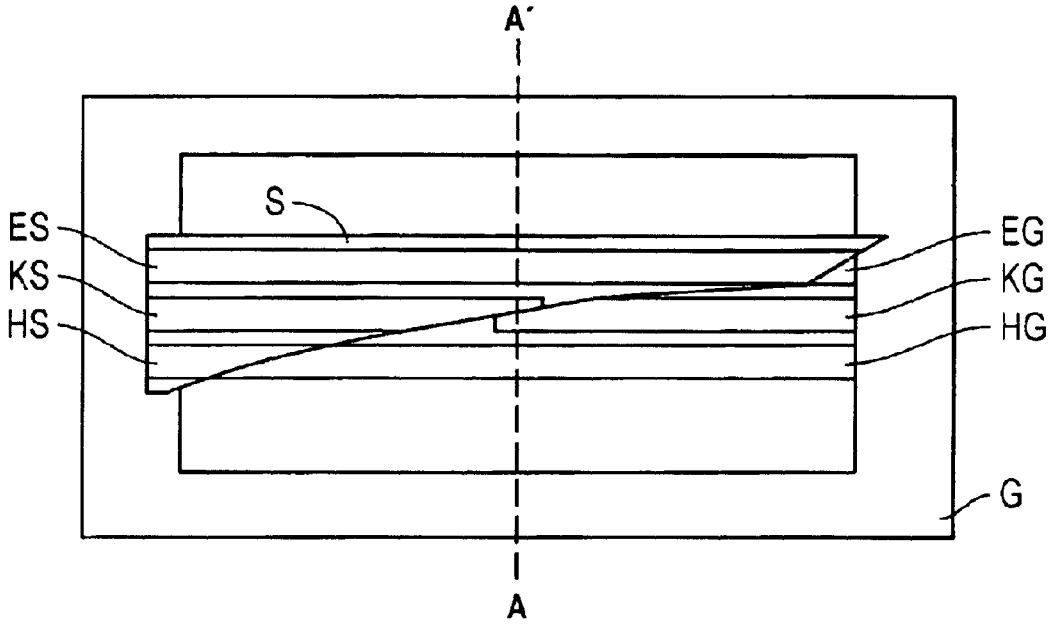

This application claims the benefit of the filing date as provided by 35 U.S.C. 119 of European patent application number 02002963-3 filed on Feb. 11, 2002, the disclosure of which is incorporated herein by reference.

BACKGROUND OF THE INVENTION

The invention relates to a microswitch in micro-electromechanical systems. Components manufactured by means of specific methods and processes, such as the lithography method, are called micro-electromechanical or micromechanical systems (MEMS). They allow the realization of electrical or also mechanical functions on a smallest scale in the $\mu$m range. Thus, for instance, microswitches for use in the radio part of mobile phones are known from Brown, Elliott R.; RF-MEMS Switches for Reconfigurable Integrated Circuits; IEEE Transaction on Microwave Theory and Techniques; Vol. 45; No. 11; November 98.

Micro-electromechanical components are formed of a plurality of thin layers of most different lateral structures lying on top of each other in a vertical direction and having most different material properties. According to the desired function the individual layers consist, for example, of conductive or insulating materials, or of materials with certain mechanical properties such as a spring constant. By corresponding processes also more complex three-dimensional structures can be produced. In a simplified fashion a microswitch can substantially be formed of three lateral layers, whereby the medium layer is again removed at the end of the manufacturing process. Thus, a microswitch consisting of a base element as the lowermost layer and a flexible switching element as the uppermost layer is formed. Both layers or, respectively, the elements of the microswitch formed thereby lie opposite each other at a defined distance, which is obtained by the remote layer disposed therebetween. Said distance largely corresponds to the deviation which has to be overcome by the flexible switching element so as to close a switching contact between the base element and the switching element. If the base element is, for example, a silicon substrate, an additional conductive layer will be disposed thereon as contact surface to which a voltage can be applied. The switching element may be made of a metallic material thereby forming itself the contact surface, to which a voltage can then be applied. Said material of the switching element is provided with a spring constant, and the switching element is at least partially connected with the base element. If a voltage difference is now applied between the contact surfaces, which together form the switching contact, the flexible switching element is deflected in the direction of the base element due to the so effected electrostatic attractive force, and the switching contact is closed. For achieving an attractive force as high as possible the dimensions of the contact surfaces lying opposite each other are as large as possible. For insulating purposes an additional oxide layer may be applied onto the contact surfaces. A direct voltage causing an electrostatic attractive force and an alternating voltage as signal to be switched can then simultaneously apply to the same contact surfaces. As was mentioned above, the flexible switching element is fixed at least on one point of its edge. In response to the type of fixing and the form of the flexible switching element the microswitches in micro-electromechanical systems are then commonly called cantilever switch, bridge switch or also membrane switch.

BRIEF SUMMARY OF THE INVENTION

Figure 2A:
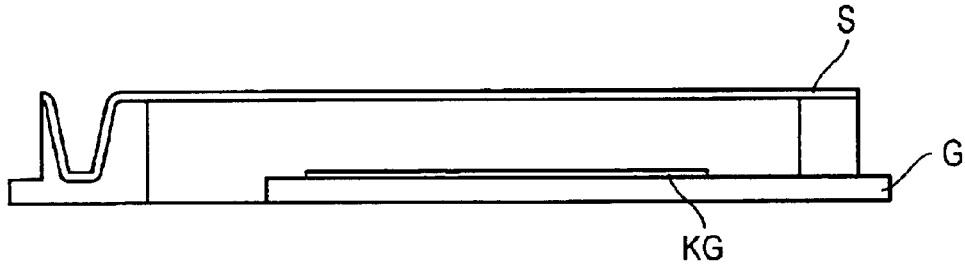
FIG. 2A (Prior Art)
Figure 2B:
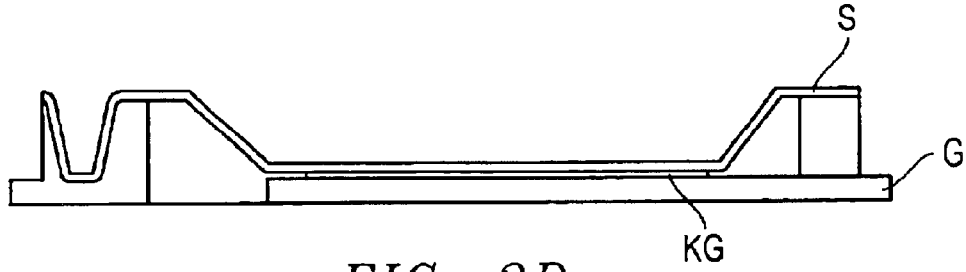
FIG. 2B (Prior Art)

FIGS. 2*a* and 2*b* show the basic structure of a prior art microswitch configured as bridge switch in the opened and closed position. The flexible switching element S is fixed at two points of its edge on the base element G in such a manner that it has a defined distance toward the base element in the open position. Due to the spring constant of the selected material and the fixing the flexible switching element is provided with a reaction force counteracting the deflection of the switching elements. A contact surface KG is disposed on the base element G, which, together with the switching element S as additional contact surface, forms the switching contact. If a voltage is applied to both contact surfaces the switching element S is moved against the reaction force in the direction of the base element G due to the thereby effected electrostatic attractive force. If the voltage as applied exceeds a certain value, the switching contact S is closed. If the voltage is removed from the contact surfaces, the switching element S will go back to its original form due to the reaction force, so that the switching contact is opened. The drawback of such switches is that, due to atomic and molecular surface forces formed when the contacts are closed, the surfaces of the switching element and the contact surface of the base element may stick together. If the surface forces are stronger than the reaction force the switching contact can no longer open. For avoiding said agglutination it is proposed to additionally apply a dielectric layer on the contact. Furthermore, it may be conceivable to increase the reaction force of the switching contact by a corresponding form and material selection. This entails that a higher response force and, thus, a higher voltage is necessary for the closing so as to overcome said greater reaction force. However, exactly when such microswitches are to be integrated in MEMS components with a small voltage supply, this is not desirable and not applicable. Moreover, higher voltages and the so caused higher attractive force include the risk that the contact tends to agglutinate more easily when closing it, namely due to the so-called contact-shattering.

U.S. Pat. No. 6,143,997 discloses a microswitch operating at low voltages. The base element comprises a contact surface and a plurality of separate electrodes. Moreover, a plurality of layers having the function of clamps for the switching element are provided on the base element. The switching element is guided by said clamps and is freely movable in a deviation range defined by the clamps. Additional counter-electrodes are applied on the side of the clamps opposite the base element as additional layer. Due to the fact that the switching element is movable, i.e. not connected in a stationary manner, no mechanical reaction force is available for opening the switching contact, but, for the opening, a first voltage potential is rather applied to the counter-electrodes and a second voltage potential is applied to the switching element so as to cause an attractive force between the counter-electrodes and the switching element. For closing the switching contact a first voltage potential is applied to the electrodes of the base element and a second voltage potential is applied to the switching element. Furthermore, the gravitational force may additionally be utilized if the microswitch is in a suitable position. Due to the fact that there is no mechanical reaction force, only the attractive force defined by the voltage on the counter-electrodes acts to open the switching contact and counteracts the gravitational force given a corresponding position. Due to the smaller forces the risk that the contact surfaces stick together is smaller. It is, however, disadvantageous that such microswitches with the above-described structures in microelectromechanical systems require additional and more complex layer structures, which render the manufacturing processes thereof more laborious and, thus, more expensive.

The present invention is therefore based on the object to provide a microswitch which counteracts the disadvantageous agglutination known from the prior art and guarantees an as easy as possible manufacturing process for the microelectromechanical system.

In accordance therewith the invention is based on the idea to provide a microswitch consisting of a base, hereinafter called base element, and a movable element called switching element. The switching element is provided with a spring constant and is, at least with a part of its edge portion, connected with the base element in a fixed manner. Thus, when the movable switching element is deflected, a reaction force is generated, which is directed opposite to the deflection. Both, the base element and the switching element each comprise at least two electrodes, hereinafter called electrode and auxiliary electrode, whereby the electrode of the base element and the one of the switching element are disposed opposite each other at a defined distance. The auxiliary electrode in both, the base element and the switching element, is provided in a lateral direction at the same distance from the respective electrode. Moreover, the base element as well as the switching element are each provided with a contact surface, which together form the switching contact of the microswitch. The distance between the electrodes of the base element and of the switching element substantially defines the deviation required by the movable switching element for closing the switching contact. If, for opening the switching contact, a voltage with a first voltage potential is applied to the electrodes and a second voltage potential of the voltage to the auxiliary electrodes, the voltage difference formed thereby causes, in a lateral direction, an electric field between the electrode and the auxiliary electrode in the base element as well as in the switching element. In correspondence with the direction of the electric field an accumulation of negative and positive charge carriers occurs on the surface portions of the electrodes and the auxiliary electrodes, which are disposed directly opposite each other in a lateral direction. In an orthogonal direction thereto, i.e. in the direction of the deviation of the switching element, the electrodes having the same charge carriers are then each disposed opposite each other. In other words, for example, an accumulation of positive charge carriers on the surface portion of the electrode of the switching element is opposite an accumulation of positive charge carriers on the surface portion of the electrode of the base element. This analogously applies to the accumulation of negative charge carriers. Thus, repulsion forces are generated between the accumulations of the same surface charges on the electrodes with the same voltage potential. As said repulsion forces substantially act in the same direction as the reaction force of the switching element, they support the reaction force of the switching element precisely at the moment of opening. This means that precisely when the contact surfaces of the switching contact start to become released or separated, the repulsion forces as generated act initially in the direction of the reaction force. Due to the fact that, prior to the opening of the switching contact, the electrodes and, respectively, the auxiliary electrodes with the same voltage potential and, thus, surface charges with the same sign are disposed very closely to each other, the repulsion forces are at this moment particularly large because of the small distance. Due to the fact that the repulsion forces act in the direction of the reaction force, they support the same when the switching contact is opened and, thus, counteract a permanent agglutination of the switching contact. It is an advantage that additional mechanical measures such as the increase of the spring constant as described in the prior art are not required for the microswitch according to the invention. Moreover, the application of additional laborious structures like the clamps and counter-electrodes known from the prior art can be waived, so that additional laborious process steps can be avoided.

Additional advantageous embodiments and preferred developments of the switch according to the invention are described in the subordinate claims.

BRIEF DESCRIPTION OF THE SEVERAL VIEW OF THE DRAWINGS

The invention will hereinafter be explained in more detail by means of the figures, wherein FIG. 1*a* shows a schematic illustration of a first embodiment of a microswitch according to the invention.

Figure 1B:
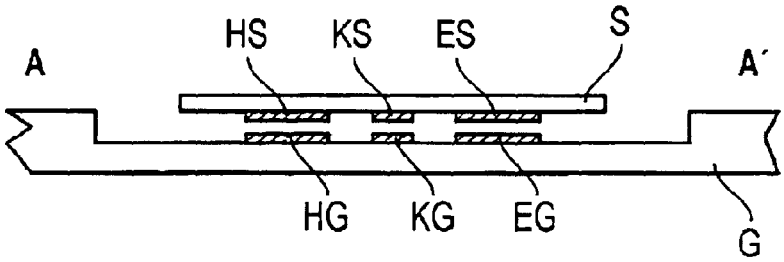

FIG. 1*b* shows a cross-section through the microswitch according to FIG. 1*a*.

Figure 1C:
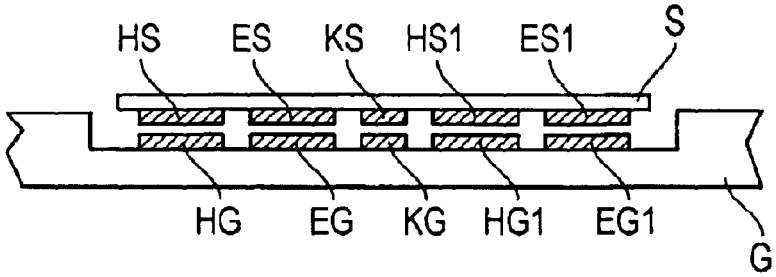

FIG. 1*c* shows a cross-section through another embodiment of a microswitch according to the invention.

Figure 1D:
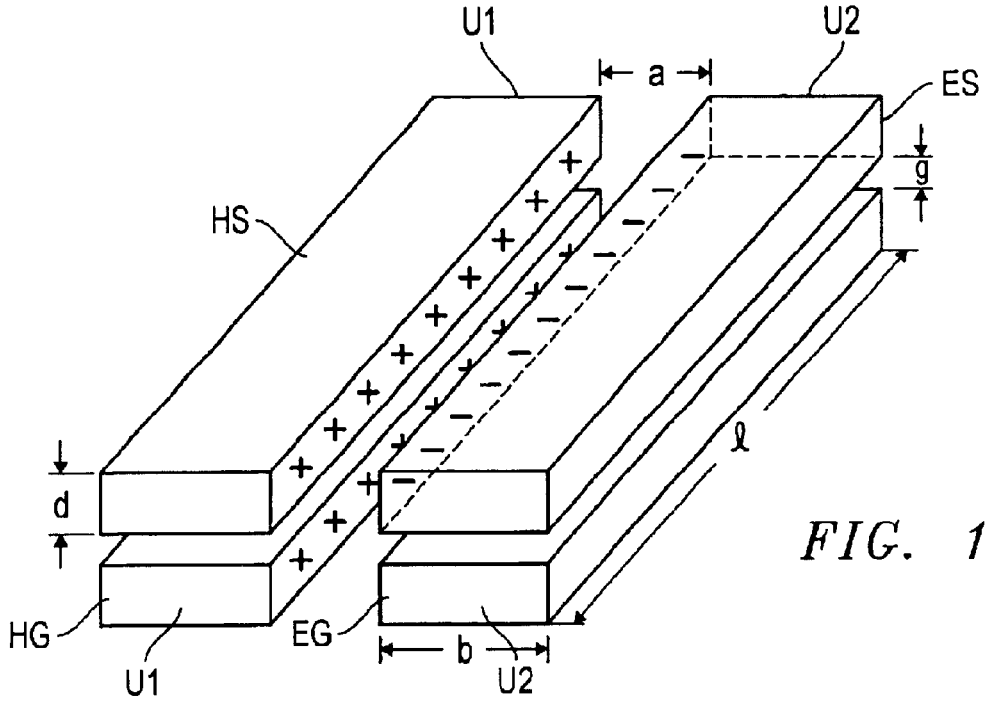

FIG. 1*d* shows a schematic illustration of the charge distribution on the electrodes of the microswitch.

FIG. 2*a* shows a known membrane switch in open position.

FIG. 2*b* shows a known membrane switch in closed position.

DETAILED DESCRIPTION OF THE INVENTION

FIG. 1*a* and FIG. 1*b* schematically show the construction of a first embodiment of a microswitch according to the invention. The base element G, which is normally formed as a base layer, comprises a recess in which are positioned the contact surface KG and the electrode EG as well as the auxiliary electrode HG. The contact surface KG as well as the two electrodes EG and HG may—as is shown in FIG. 1*b*—be applied as additional layers on the surface of the recess of the base element G, but may likewise be integrated in the layer that forms the base element G. The latter arrangement requires more complex lateral structures, but no additional layers in vertical direction. In another layer, the switching element S is then designed as to span a bridge over the recess of the base element G by being firmly connected with the base element at the two marginal portions of the bridge. The contact surface KS as well as the electrode ES and the auxiliary electrode HS are located on the underside, i.e. on the side facing the base element G, of the switching element S. Here, too, electrodes ES and HS may be applied as an additional layer on the switching element S, as is shown in FIG. 1*b*, or may also be integrated in the layer forming the switching element S. Electrodes EG and ES as well as the auxiliary electrodes HG and HS may be connected with a voltage source (not shown) by means of suitable feed lines. The contact surfaces KG and KS may be connected with the signal path to be switched by means of suitable feed lines, so that in a closed position of the switching contact, i.e. when the two contact surfaces KG and KS touch each other, the signal path is closed. If a voltage is now applied between the electrodes EG and ES, an electrostatic field is produced as result of the voltage difference between the electrodes EG and ES, which field effects an attractive force. The switching element S is, thus, deflected in the direction of the base element G or, more precisely, in the direction of the electrode EG positioned in the recess of base element G. This deflection produced by the voltage as applied is counteracted by a reaction force, which is defined by the material as used and by the kind of fastening the switching element S. If the attractive force is larger than the reaction force, the switching contact is closed. If the voltage is removed from the contacts EG and ES, the switching element S will return to its original position as a result of the reaction force, so that the switch or, respectively, the switching contact is opened. As had already been described above, however, it may occur that the contact surfaces KG and KS, or also other surface components of the switching element, may stick to the base element due to adhesion or other surface properties, when the switching contact is closed. The surface force produced thereby counteracts the reaction force and has the effect that the switching contact can no longer be opened. Therefore, it is suggested that an auxiliary electrode HG, HS is provided on both the base element G and the switching element S in lateral direction, each at a distance a next to the electrode EG, ES and that said electrodes EG and ES or, respectively, the auxiliary electrodes HG and HS are connected with the voltage source such that a first positive voltage potential U1 is applied to both electrodes EG and ES and a second negative voltage potential U2 of the voltage is applied to the auxiliary electrodes HG and HS for opening the switching contact. Due to the different voltage potentials between electrode EG, ES and auxiliary electrode HG, HS an accumulation of surface charges takes place on the surface portions of the electrodes EG, ES, HG, HS in a lateral direction, namely on the surfaces lying directly opposite each other in a lateral direction. In the present example this means that an accumulation of positive charge carriers occurs on a surface portion of the electrodes EG, ES and that an accumulation of negative charge carriers occurs on a surface portion of the auxiliary electrodes HG, HS. As a consequence, surface portions are opposite each other in an orthogonal direction, i.e. in the vertical direction of the micro-electromechanical layers, which have an accumulation of surface charges with the same sign. This, again, leads to repulsive powers between the rectified charge carriers and, thus, between electrode ES of the switching element S and electrode EG of the base element G and, correspondingly, for the auxiliary electrodes HG and HS. The repulsive powers have their highest concentration when the switching contact S is opened, i.e. exactly when electrodes EG and ES or, respectively, auxiliary electrodes HG and HS are closest to each other. They act in the same direction as the mechanical reaction force and support the same in opening the switching contact. Ideally, the electrodes EG, ES, HG, HS are constructed such that they are designed as strip lines, which is schematically illustrated in FIG. 1*a*. Said strip lines have a width b and a length l, whereby the so defined surface portion of the electrodes EG, ES, HG, HS for the attractive forces effected by the electric field should be dimensioned sufficiently large for closing the switch. The strip lines moreover have a thickness d which is substantially smaller than the longitudinal dimension l. The strip electrodes EG, ES, HG, HS are arranged to each other on the base element G and the switching element S such that they lie parallel to each other in their longitudinal dimension l. This leads to an accumulation of charge carriers on the surface portion of the electrodes EG, ES, HG, HS, which is defined by the longitudinal dimension l and thickness d. In other words, by applying a voltage to the electrodes EG, ES and the auxiliary electrodes HG, HS positive charges will accumulate on that surface of electrodes EG and ES lying closest to the respective auxiliary electrode, which is schematically illustrated in FIG. 1*d*. In correspondence therewith, negative charges will accumulate on the surface of the auxiliary electrodes HG and HS, which lies closest to the respective electrode. Due to the fact that said surfaces lie at the same distance a to each other, the charge accumulations will also lie opposite each other in a vertical direction, and an orthogonal system of surface portions each with an accumulation of same charge carriers is formed. The so effected repulsive powers in vertical direction support the reaction force. Expediently, a dielectric material having the dielectric constant □r is disposed between the electrode EG, ES and the auxiliary electrode HG HS. Thus, an even larger electrostatic field is generated between the electrode and the auxiliary electrode, which leads to an increased accumulation of surface charges on the surface portions of electrodes EG, ES, HG, HS. The repulsive powers acting in a vertical direction can thereby be further increased. Ideally, such an arrangement can be realized as a lateral structure in one single layer. This means that the electrodes EG, ES, HG, HS and the dielectric material substantially form the switching element S.

For closing the switching contact the voltage potential on at least one of the electrodes has to be switch-selectable between U1 and U2 so as to effect, due to the different voltage potentials as described above, an attraction of the electrodes EG, ES, HG, HS between the base element G and the switching element S. Said attractive forces may still be increased if the voltage potential is additionally switched over on another electrode EG, ES, HG, HS, so that, for instance, the first voltage potential U1 is applied to electrode ES and auxiliary electrode HS of the switching element S, and the second voltage potential U2 is applied to electrode EG and the auxiliary electrode HG, or vice versa.

As is shown in FIG. 1*a*, the contact surfaces KS, KG of the switching element S and the base element G may be arranged between the electrodes EG, ES or, respectively, the auxiliary electrodes HG, HS. The contact surfaces KS and KG, however, lie directly opposite each other only in a partial area which forms the switching contact. The embodiment of the contact surfaces KS, KG of a microswitch shown herein is especially suited for applications where RF signals have to be switched, such as in the radio part of portable terminals. In connection with RF signals it is advantageous that the signal paths, here the contact surfaces, overlap as little as possible as to avoid capacitive couplings. Moreover, microswitches according to the present invention can advantageously be used exactly in this field, as the voltage supply available in such portable terminals is only small, i.e. the components as used should have as little supply voltages as possible.

FIG. 1*c* schematically shows another embodiment of a microswitch according to the invention. As is seen in FIG. 1*c*, the contact surfaces KS, KG of the switching element S and the base element G may also be arranged between two pairs of one electrode and one auxiliary electrode respectively. This means that the base element G as well as the switching element S each comprise an additional electrode EG1 and ES1 as well as an additional auxiliary electrode HG1 and HS1. The same are, again, arranged parallel to each other at a distance a. The contact surfaces KG and KS are disposed between the first pair consisting of electrode EG, ES and auxiliary electrode HG, HS and the second pair consisting of the additional electrode EG1, ES1 and auxiliary electrode HG1, HS1. Again, the contact surfaces KG and KS lie opposite each other only in partial area which forms the switching contact. Such an arrangement is especially preferable, if the contact surfaces have a width that does not allow the arrangement of the same between an electrode and an auxiliary electrode, i.e. if, for example, the width of the contact surface is larger than the distance a between the electrode and the auxiliary electrode. In order to obtain the same effect as in the first embodiment, i.e. the generation of repulsive forces for opening the contact, at least one pair of electrode and auxiliary electrode is necessary at all times.

The present invention is not restricted to the embodiments as described, but is rather independent of the kind and form of the suspension of the switching element. This means that, for example in connection with cantilever or membrane switches, the concept according to the invention can be applied correspondingly. The same refers to the construction of the contact surfaces. Thus, it is conceivable, for instance, that two contact surfaces are provided on the base element, which are bridged by a contact surface of the switching element. The same refers to the form of the electrodes, auxiliary electrodes or contact surfaces. Thus, it is conceivable that the same are, for instance, of a meander-shaped or spiral structure. In connection with all embodiments it is essential that, in correspondence with the inventive concept relating to the arrangement and the construction and the connection of the electrodes and auxiliary electrodes, the generation of repulsive powers effects a support of the reaction force when the switching contact is opened, so as to reduce the risk of conglutination.

The microswitches shown in FIGS. 1*a–d* have been illustrated in an abstract manner so as to show the essential aspects of the invention only. Depending on the purpose of application or used technology, the person skilled in the art will thereby obtain most different embodiments with most different structures, without deviating thereby from the basic principle of the invention.

What is claimed:

1. Microswitch, comprising a base element (G) with a contact surface (KG) and an electrode (EG), and a switching element (S) with a contact surface (KS) and an electrode (ES) disposed opposite the electrode (EG) of the base element (G) at a distance (g), wherein the switching element (S) is provided with a spring constant and is connected at least with a part of its edge portion with the base element (G) in a fixed manner, and wherein the contact surfaces (KG, KS) form a switching contact and the switching contact is closable against a reaction force caused by the spring constant by means of a voltage applied to the electrodes (EG, ES), wherein the base element (G) and the switching element (S) comprise an auxiliary electrode (HG, HS) in a lateral direction at a distance (a) from the electrode (EG, ES) to which a voltage can be applied, and the voltage can be applied to the electrodes (EG, ES) and the auxiliary electrodes (HG, HS) for opening the switching contact, so that the electrodes (EG, ES) have a first voltage potential (U1) and the auxiliary electrodes have a second voltage potential (U2) which effect an accumulation of positive and negative charge carriers on the surface portions of the electrodes (EG, ES) and the auxiliary electrodes (HG, HS) such that surface portions with positive and negative charge carriers are opposite each other in a lateral direction and surface portions with the same charge carriers are opposite each other in an orthogonal direction.

2. Microswitch according to claim 1, wherein one of the electrodes (EG, ES) or auxiliary electrodes (HG, HS) can be switched over between the first (U1) and the second (U2) voltage potential for closing the switching contact.

3. Microswitch according to claim 2, wherein an additional one of the electrodes (EG, ES) or auxiliary electrodes (HG, HS) can be switched over between the first (U1) and the second (U2) voltage potential for closing the switching contact so that the first voltage potential (U1) is applied to the electrode (ES) and the auxiliary electrode (HS) of the switching element (S) and the second voltage potential (U2) is applied to the electrode (EG) and the auxiliary electrode (HG) of the base element (G).

4. Microswitch according to claim 1, wherein the electrodes (EG, ES) and the auxiliary electrodes (HG, HS) each comprise a surface portion defined by the thickness (d) and length (l) thereof, wherein the length (l) is larger than the thickness (d), and wherein the electrode (EG, ES) and the corresponding auxiliary electrode (HG, HS) of the base element (G) and the switching element (S) are each arranged in parallel with said surface portion.

5. Microswitch according to claim 1, wherein a dielectric material is arranged between the electrode (EG, ES) and the auxiliary electrode (HG, HS) of the base element (G) and/or the switching element (S).

6. Microswitch according to claim 1, wherein the contact surface (KG, KS) is arranged between the electrode (EG, ES) and the auxiliary electrode (HG, HS), wherein the contact surfaces (KG, KS) are opposite each other only in a partial area which forms the switching contact.

7. Microswitch according to claim 1, wherein the contact surface (KG, KS) is part of the electrode (EG, ES) or the auxiliary electrode (HG, HS).

8. Microswitch according to claims 1, wherein the base element (G) and the switching element (S) each comprise an additional electrode (EG1, ES1) and an additional auxiliary electrode (HG1, HS1) which again are arranged parallel to one another at a distance (a), and wherein the contact surface (KG, KS) is arranged between the first pair formed of electrode (EG, ES) and auxiliary electrode (HG, HS) and the second pair formed of the additional electrode (EG1, ES1) and the auxiliary electrode (HG1, HS1), wherein the contact surfaces (KG, KS) are opposite each other only in a partial area which forms the switching contact.

* * * * *